US008409774B2

(12) United States Patent
Okita

(10) Patent No.: US 8,409,774 B2
(45) Date of Patent: Apr. 2, 2013

(54) TONER FOR DEVELOPING ELECTROSTATIC LATENT IMAGE

(75) Inventor: Masaki Okita, Ise (JP)

(73) Assignee: Kyocera Document Solutions Inc. (JP)

( * ) Notice: Subject to any disclaimer, the term of this patent is extended or adjusted under 35 U.S.C. 154(b) by 638 days.

(21) Appl. No.: 12/548,539

(22) Filed: Aug. 27, 2009

(65) Prior Publication Data

US 2010/0055596 A1 Mar. 4, 2010

(30) Foreign Application Priority Data

Aug. 29, 2008 (JP) ..... 2008-222493

(51) Int. Cl.
*G03G 9/087* (2006.01)
*G03G 9/097* (2006.01)

(52) U.S. Cl. ..... 430/108.1; 430/108.8

(58) Field of Classification Search ..... 430/108.1, 430/108.8

See application file for complete search history.

(56) References Cited

U.S. PATENT DOCUMENTS

| | | | | |
|---|---|---|---|---|
| 5,605,778 | A | 2/1997 | Onuma et al. | 430/110 |
| 6,899,985 | B2 * | 5/2005 | Inoue et al. | 430/108.8 |
| 7,144,667 | B2 * | 12/2006 | Kawanishi et al. | 430/108.8 |
| 2006/0233865 | A1 * | 10/2006 | Odajima et al. | 424/443 |

FOREIGN PATENT DOCUMENTS

| | | |
|---|---|---|
| JP | 8-106173 | 4/1996 |
| JP | H8-278657 | 10/1996 |
| JP | H8-334920 | 12/1996 |
| JP | 3210245 | 9/2001 |
| JP | 2002-40706 | 2/2002 |
| JP | 2002-323793 | 11/2002 |
| JP | 2003-91094 | 3/2003 |
| JP | 2006-267280 | 10/2006 |

OTHER PUBLICATIONS

Machine Translation of JP 8334920 A.*

* cited by examiner

*Primary Examiner* — Jonathan Jelsma
(74) *Attorney, Agent, or Firm* — Ostrolenk Faber LLP

(57) ABSTRACT

A toner for developing an electrostatic latent image, the toner comprising: a releasing agent; and a binder resin, wherein: the releasing agent includes at least a first releasing agent material and a second releasing agent material, the first releasing agent material having a different melting point compared to the second releasing agent material; and a differential scanning calorimetric curve, obtained by measuring the toner for developing the electrostatic latent image by means of a differential scanning calorimeter, exhibits a shoulder at a temperature in a range of 50° C. to 53° C. corresponding to a glass transition temperature of the toner for developing the electrostatic latent image, and also exhibits a local maximum point at a temperature in a range of 90° C. to 95° C.

12 Claims, 1 Drawing Sheet

TONER FOR DEVELOPING ELECTROSTATIC LATENT IMAGE

BACKGROUND OF THE INVENTION

The present application claims priority on Japanese Patent Application No. 2008-222493, filed Aug. 29, 2008, the content of which is incorporated herein by reference.

FIELD OF THE INVENTION

The present invention relates to a toner for developing an electrostatic latent image formed by, for example, electrophotography, electrostatic recording, and electrostatic printing.

BACKGROUND OF THE INVENTION

Image forming devices that do not heat fixing rollers as much as possible are in demand. These image forming devices capable of performing low-temperature fixing are preferable in order to conserve energy and to reduce the size of the devices. Thus, the toner for developing an electrostatic latent image (hereinafter may be referred to as "toner") is expected to perform low-temperature fixing more effectively. At the same time, it is preferable that the toner does not melt and adhere easily to a heated fixing roller. In other words, a high-temperature offset of the toner is expected to occur at a high temperature (high-temperature offset resistance characteristics). Furthermore, the toner is expected to have excellent properties in heat-resistant preservability.

One way to enhance the low-temperature fixing characteristics of the toner is to lower the glass transition temperature (hereinafter may be referred to as "Tg") of a binder resin contained in the toner. However, when the glass transition temperature of the binder resin is simply lowered, the heat-resistant preservability of the toner may deteriorate.

According to techniques designed to solve the problems described above, a releasing agent is blended into the toner so that a specific differential scanning calorimetric (hereinafter may be referred to as "DSC") curve can be obtained from the toner or the releasing agent. Such techniques are disclosed in, for example, Japanese Unexamined Patent Application, First Publication No. H8-334920, Japanese Unexamined Patent Application, First Publication No. H8-278657, Japanese Patent No. 3210245, Japanese Unexamined Patent Application, First Publication No. 2002-323793, and Japanese Unexamined Patent Application, First Publication No. 2002-40706.

However, there is a demand for a toner that has even more excellent fixing properties such as low-temperature fixing characteristics and high-temperature offset resistance characteristics as well as heat-resistant preservability properties.

Therefore, the present invention aims to provide a toner that is excellent in fixing properties such as low-temperature fixing and high- temperature offset resistance as well as in heat-resistant preservability.

SUMMARY OF THE INVENTION

In order to achieve the above object, the present invention employs the following.

Namely, a toner for developing an electrostatic latent image according to an aspect of the present invention includes: a releasing agent; and a binder resin, wherein: the releasing agent includes at least a first releasing agent material and a second releasing agent material, the first releasing agent material having a different melting point compared to the second releasing agent material; and a differential scanning calorimetric curve, obtained by measuring the toner for developing the electrostatic latent image by means of a differential scanning calorimeter, exhibits a shoulder at a temperature in a range of 50° C. to 53° C. corresponding to a glass transition temperature of the toner for developing the electrostatic latent image, and also exhibits a local maximum point at a temperature in a range of 90° C. to 95° C.

In addition, the toner for developing the electrostatic latent image according to the aspect of the present invention is preferred to be configured as follows: the differential scanning calorimetric curve exhibits an endotherm starting temperature caused by the releasing agent in a range of 65° C. to 70° C., an endotherm ending temperature caused by the releasing agent in a range of 135° C. to 140° C., a lowest endothermic peak temperature caused by the first releasing agent material in a range of 80° C. to 85° C., and a highest endothermic peak temperature caused by the second releasing agent material in a range of 127° C. to 133° C.

In addition, the toner for developing the electrostatic latent image according to the aspect of the present invention may be configured as follows: the binder resin is a polyester resin.

In addition, the toner for developing the electrostatic latent image according to the aspect of the present invention may be configured as follows: the first releasing agent material and the second releasing agent material are melt-blended in advance, creating a melt-blended material, and the melt-blended material is melt-kneaded with the binder resin.

In addition, the toner for developing the electrostatic latent image according to the aspect of the present invention may be configured as follows: a mass of the first releasing agent material contained in the toner for developing the electrostatic latent image is in a range of 40% to 60% of a total mass of the first releasing agent material and the second releasing agent material.

In addition, the toner for developing the electrostatic latent image according to the aspect of the present invention may be configured as follows: a mass of the first releasing agent material contained in the toner for developing the electrostatic latent image is in a range of 45% to 55% of a total mass of the first releasing agent material and the second releasing agent material.

Based on the toner for developing the electrostatic latent image according to the aspect of the present invention described above, it is possible to enhance fixing properties such as low-temperature fixing and high-temperature offset resistance as well as heat-resistant preservabilily.

The above object as well as other objects of the present invention and the present invention's characteristics and advantages will become clearer from the appended figures and the detailed description below.

DETAILED DESCRIPTION OF THE PREFERRED EMBODIMENTS

Hereunder, an embodiment of a toner for developing an electrostatic latent image according to the present invention is described with reference to the drawings. The toner includes at least two types of releasing agents and a binder resin. The glass transition temperature Tg of the toner is in the range of 50° C. to 53° C. When the toner is measured by means of a differential scanning calorimeter (DSC), a DSC curve is obtained showing that the toner begins to absorb heat at a temperature in the range of 65° C. to 70° C., and finishes absorbing heat at a temperature in the range of 135° C. to 140° C. The releasing agent causes the heat absorption (hereinafter also referred to as "endotherm"). The DSC curve shows that a lowest-temperature endothermic peak occurs at a temperature in the range of 80° C. to 85° C., a highest-temperature endothermic peak occurs at a temperature in the range of 127° C. to 133° C., and a local maximum point occurs at a temperature in the range of 90° C. to 95° C.

The vertical axis of the DSC curve represents the endotherm value. The negative value becomes larger toward the lower section of the vertical axis. In other words, the DSC curve shows the endotiermic peak as a peak convexed downward (valley peak), and shows the heat generation peak as a peak convexed upward (mountain peak). Hereinafter, a peak of the DSC curve convexed upward will be called a local maximum. A peak of the DSC curve convexed downward will be called a local minimum.

Figure 1:
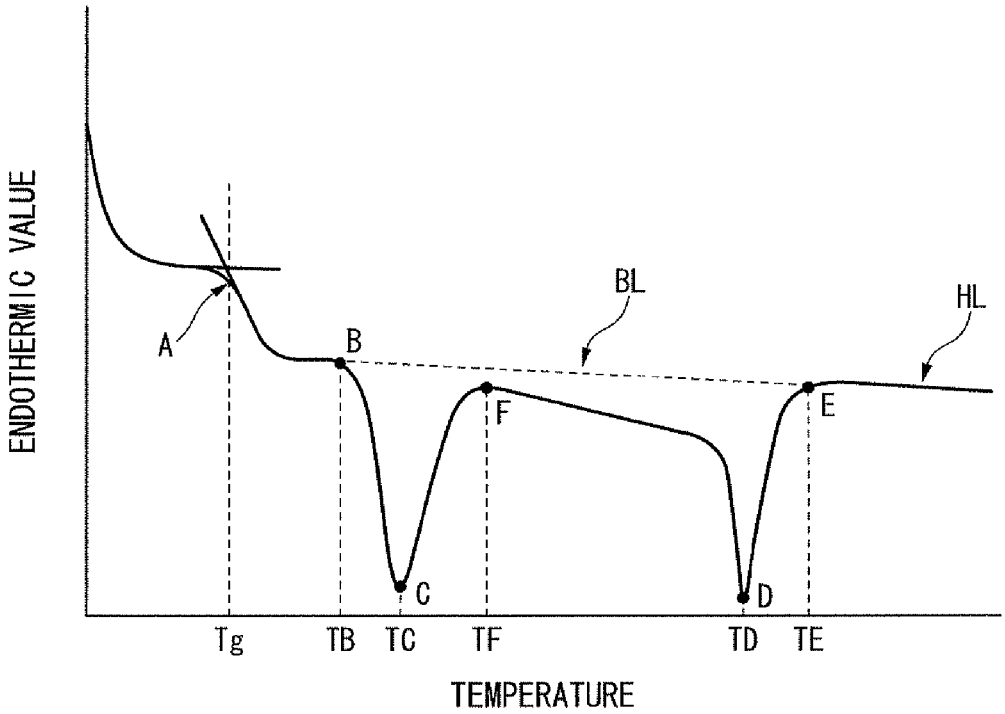
FIG. 1 shows a typical example of a DSC curve obtained by measuring a toner according to an embodiment of the present invention.

FIG. 1 shows a typical example of a DSC curve obtained by measuring a toner according to the embodiment of the present invention, the toner including two types of releasing agents that have different melting points.

Differential scanning calorimetry is performed by using a differential scanning calorimeter "DSC6200" manufactured by Seiko Instruments Inc. The temperature of the sample (the toner) is raised to 170° C. The temperature of the sample is temporarily reduced at a rate of 10° C. per minute from 170° C. to 30° C. Then, the sample is heated again so that the temperature of the sample increases at a rate of 10° C. per minute from 30° C. to 170° C. The DSC curve is obtained by the procedure described above. The weight of the sample is 10 mg.

A shoulder of the DSC curve representing a change in specific heat is observed in the range of 50° C. to 53° C. as shown in FIG. 1. The glass transition temperature Tg of the toner is the temperature corresponding to the intersection of two tangential lines of this shoulder. Point A is a point on the DSC curve corresponding to the temperature Tg.

At point B, the DSC curve starts inflecting by moving away from the baseline shown as BL in FIG. 1. In other words, heat absorption starts at point B. Point B is observed at a temperature in the range of 65° C. to 70° C. Hereinafter, the temperature at point B is referred to as the "endotherm starting temperature (TB)."

Point C represents the endothermic peak observed at the lowest temperature in the DSC curve which is obtained by starting the endotherm caused by the releasing agent at a temperature in the range of 65° C. to 70° C. and completing the endotherm at a temperature in the range of 135° C. to 140° C. In other words, point C represents the lowest-temperature endothermic peak. The endotherm, which begins at point B, reaches a peak at point C. Point C is observed as a local minimum point at a temperature in the range of 80° C. to 85° C. Hereinafter, the temperature at point C is referred to as the "lowest endothermic peak temperature (TC)."

Point D represents the endothermic peak observed at the highest temperature in the DSC curve which is obtained by starting the endotherm caused by the releasing agent at a temperature in the range of 65° C. to 70° C. and completing the endotherm at a temperature in the range of 135° C. to 140° C. In other words, point D represents the highest-temperature endothermic peak. This peak is observed as a local minimum point at a temperature in the range of 135° C. to 140° C. Hereinafter, the temperature at point D is referred to as the "highest endothermic peak temperature (TD)."

At point E, the DSC curve merges with the baseline, indicating that heat absorption has ended. Point E is observed at a temperature in the range of 135° C. to 140° C. Hereinafter, the temperature at point E is referred to as the "endotherm ending temperature (TE)."

Point F represents a local maximum point observed at a temperature in the range of 90° C. to 95° C. between the lowest-temperature endothermic peak and the highest-temperature endothermic peak. Here, point F indicates that the heat absorption of the highest-temperature endothermic peak begins before the heat absorption of the lowest-temperature endothermic peak has ended. Thus, the toner is absorbing heat at point F. As a result, point F is observed in the endothermic region below the baseline BL in FIG. 1. Point F is not observed along the baseline BL. Neither is point F observed in the region above the baseline BL. Hereinafter, the temperature at point F is referred to as the "in-between-peak temperature TF."

Incidentally, the endotherm starting temperature TB and the endotherm ending temperature TE are determined based on the baseline BL described above. The baseline BL is a portion of the DSC curve at a temperate range in which the endothermic peak of the sample has not occurred. Thus, the baseline BL includes the line HL corresponding to temperatures higher than the endotherm ending temperature TE and the extension of the line HL.

When a toner is measured by differential scanning calorimetry and the DSC curve shown in FIG. 1 is obtained as a result of the measurement, the toner exhibits excellent fixing properties such as low-temperature fixing characteristics and high-temperature offset resistance characteristics as well as excellent heat-resistant preservability properties.

In this case, when the glass transition temperature Tg of the toner is below 50° C., the heat-resistant preservability of the toner decreases even though the low-temperature fixing property improves, because the toner tends to melt and adhere with another toner. On the other hand, when the glass transition temperature Tg of the toner is above 53° C., it becomes difficult to maintain the low-temperature fixing characteristics.

The glass transition temperature Tg of the toner is obtained by the change in the specific heat of the binder resin contained in the toner.

The heat absorption, which begins at point B and reaches a peak at point C, is observed because, among the two types of releasing agents contained in the toner, the releasing agent with a lower melting point melts.

Here, if the endotherm starting temperature TB is below 65° C., primarily the high-temperature offset resistance tends to decline. In some cases, the toner will not separate from the fixing roller when fixing is performed. As a result, the recording medium such as paper might wind around the fixing roller. Thus, the separating properties decline. At the same time, the heat-resistant preservability characteristics of the toner tend to decline as well. Whether these tendencies exist depends on the temperatures TC, TD, TE, and TF.

Meanwhile, if the endotherm starting temperature TB is above 70° C., the low-temperature fixing characteristics tend to decline.

When the lowest endothermic peak temperature (TC) is below 80° C., the high-temperature offset resistance declines. In addition, the toner might not separate from the fixing roller at the time of fixing, and paper (a recording medium) might wind around the fixing roller. Moreover, the heat-resistant preservability characteristics of the toner decline as well. Meanwhile, when the lowest endothermic peak temperature (TC) is above 85° C., the low-temperature fixing properties tend to decline.

The heat absorption, which peaks at point D and ends at point E, is observed because, among the two types of releasing agents contained in the toner, the releasing agent with a higher melting point melts.

If the highest endotiermic peak temperature TD is below 127° C., the high-temperature offset resistance characteristics decline. As a result, the toner will not separate from the fixing roller when fixing is performed. Consequently, the recording medium such as paper might intertwine with the fixing roller. In addition, the heat-resistant preservability of the toner also declines. Meanwhile, if the highest endotiermic peak temperature TD is above 133° C., the low-temperature fixing characteristics tend to decline.

When the endotherm ending temperature TE is below 135° C., the high-temperature offset resistance characteristics decline. As a result, the toner will not separate from the fixing roller when fixing is performed. Thus, the recording medium such as paper might intertwine with the fixing roller. In addition, the heat-resistant preservability characteristics of the toner decline as well. Meanwhile, if the endotherm ending temperature TE is above 140° C., the low-temperature fixing capability tends to decline.

It is preferable that the in-between-peak temperature TF is in the range of 90° C. to 95° C. When the in-between-peak temperature TF is in this temperature range, the releasing agent contained in the toner operates in a well-balanced manner to improve the low-temperature fixing characteristics, the high-temperature offset resistance capability, and the heat-resistant preservability properties. Accordingly, excellent toner characteristics are obtained in a broad range of temperatures from low temperatures to high temperatures.

More specifically, when the in-between-peak temperature TF is in the range of 90° C. to 95° C., the releasing agent with a lower melting point (the first releasing agent) melts at a low temperature. As a result, the first releasing agent improves the low-temperature fixing characteristics. On the other hand, the releasing agent with a higher melting point (the second releasing agent) absorbs heat at a high temperature. As a result, the second releasing agent prevents heat from spreading to the binder resin contained in the toner. Consequently, the decline in heat-resistant characteristics due to the binder resin is avoided. The heat-resistant preservability of the toner is thus improved.

In this case, point F is observed in the endothermic region below the baseline BL in FIG. 1. In other words, point F is not observed on the baseline BL. Neither is point F observed in the region above the baseline BL. Therefore, the above excellent characteristics of the toner due to the releasing agent are obtained continuously at a wide range of temperatures.

Supposing, for instance, that the in-between-peak temperature TF is outside the range of 90° C. to 95° C., the releasing agents do not operate in a well-balanced manner. Thus, the releasing agents added to the toner do not adequately exhibit their intended effect. As a result, the heat-resistant preservability characteristics may decline. In addition, at least one of the low-temperature fixing capability or the high-temperature offset resistance capability may be inadequate.

As long as the DSC curve shown in FIG. 1 is observed, there is no particular restriction on the types of the releasing agent and the binder resin used in the toner. Examples of the releasing agent include olefinic wax such as synthetic polyethylene wax and synthetic polypropylene wax; plant-wax such as carnauba wax, rice wax, and candelilla wax; mineral-wax such as montan wax; Fischer-Tropsch wax produced from coal and natural gas, etc., by using the Fischer-Tropsch process; petroleum wax such as paraffin wax and microcrystalline wax; ester wax; and Teflon wax (Teflon is a registered trademark).

It is necessary to use at least two types of releasing agents.

It is preferable that the total amount of the releasing agent contained in the toner is 4% to 10% of the mass of the toner, more preferably, 5% to 7% of the mass of the toner. If the percentage of the total amount of the releasing agent is less than the range described above, it is difficult to obtain the intended effects of adding the releasing agent to the toner. In other words, it is difficult to adequately improve the low-temperature fixing characteristics and the heat-resistant preservability properties. Furthermore, the fixing might not be performed desirably, and toner blocking might occur. On the other hand, if the percentage of the total amount of the releasing agent is greater than the range described above, the releasing agent does not dissipate well enough in the toner. Thus, it is highly likely that the releasing agent becomes isolated in the toner. This isolation of the releasing agent may trigger drum filming by contaminating the photoreceptor. In addition, the distribution of the electrostatic charge amount may be greatly disturbed. Consequently, the image density might decline, and defects in images including fogging might occur.

When two types of releasing agents are used, it is preferable that the amount of one of the releasing agents is 40% to 60% of the mass of the two types of releasing agents combined, more preferably, 45% to 55%. In other words, it is preferable that the two types of releasing agents are blended so that the mass ratio of the releasing agents ranges from 40:60 to 60:40, more preferably, from 45:55 to 55:45. When the two types of releasing agents are blended according to the above ratio, it is possible to obtain well-balanced effects of low-temperature fixing and heat-resistant preservability. Thus, the properties of the toner can be adequately improved.

Turning to binder resin, any known binder resin may be used as long as the glass transition temperature Tg obtained from the DSC curve of the toner is in the range of 50° C. to 53° C. Using polyester resin as the binder resin is preferable because the above glass transition temperature Tg can be obtained, contributing to a toner that has both excellent fixing properties such as low-temperature fixing characteristics as well as excellent heat-resistant preservability.

It is possible to use polyester resin obtained by the polycondensation of known polyhydric alcohol and polycarboxylic acid.

Examples of the polyhydric alcohol include diols such as ethylene glycol, diethylene glycol, triethylene glycol, 1,2-propylene glycol, 1,3-propylene glycol, 1,4-butanediol, neopentyl glycol, 1,4-butane diol, 1,5-pentane diol, 1,6-hexane diol, 1,4-cyclohexane diol, dipropylene glycol, polyethylene glycol, polypropylene glycol, and polytetramethylene glycol; bisphenols such as bisphenol A, hydrogenated bisphenol A, polyoxyethylene bisphenol A, and polyoxypropylene bisphenol A; three- or more-valent alcohols such as sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methylpropanetriol, 2-methyl- 1,2,4-butanetriol, trimethylol ethane, trimethylol propane, and 1,3,5-trihydroxymethylbenzene. Among the above polyalcohols, one type of polyalcohol may be used on its own. A combination of two or more types of the above polyalcohols may also be used.

Examples of polycarboxylic acid include dihydric carboxylic acids such as maleic acid, fumaric acid, citraconic acid, itaconic acid, glutaconic acid, phthalic acid, isophthalic acid, cyclohexanedicarboxylic acid, succinic acid, adipic acid, sebacic acid, azelaic acid, malonic acid, n-butylsuccinic acid, n-butenylsuccinic acid, isobuylsuccinic acid, isobutenylsuccinic acid, n-ocylsuccinic acid, n-octenylsuccinic acid, n-dodecylsuccinic acid, n-dodecenylsuccinic acid, isododecylsuccinic acid, and isododecynylsyccinic acid; trivalent or more carboxylic acids such as 1,2,4-benzenetricarboxylic acid (trimellitic acid), 1,2,5- benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methylmethylenecarboxypropane, 1,2,4-cyclohexanetricarboxylic acid, tetra(methylenecarboxyl)methane, 1,2,7,8-octanetetracarboxylic acid, pyromellitic acid, and empol trimer. Among the above polycarboxylic acids, one type of polycarboxylic acid may be used on its own. A combination of two or more types of the above polycarboxylic acids may also be used. In addition, these polycarboxylic acids may be used in the form of an acid anhydride or partial-esterification product.

It is possible to use polyester resin as the binder resin, wherein the polyester resin is formed by usual processes from raw materials described above.

For example, an alcohol component (such as the polyhydric alcohol described above) and an acid component (such as the polycarboxylic acid described above) are mixed in a reaction container at a predetermined ratio. In the presence of a catalyst, reaction begins at a temperature in the range of 150° C. to 190° C. while inactive gas such as nitrogen is blown in. A low-molecular compound, produced as a by-product during the reaction, is continuously removed from the reaction system. Then, the polyester resin is obtained by raising the reaction temperature to a temperature in the range of 210° C. to 250° C., thereby facilitating the reaction.

The reaction can be carried out under ordinary pressure, reduced pressure, and enhanced pressure. However, when the reaction rate has reached a percentage in the range of 50% to 90%, it is preferable to carry out the reaction under reduced pressure at or below 200 mmHg. The mass average molecular weight and the number average molecular weight of the polyester resin can be adjusted by controlling the reaction temperature described above.

Examples of the catalyst include metal such as stannum, titanium, stibium, manganese, nickel, zinc, lead, iron, magnesium, calcium, and germanium; as well as compound containing the above metal.

Further, it is preferable that the acid number of the polyester resin be less than or equal to 10. In the case of positive charge toners, the positive charge characteristics might decline when the acid number of the polyester resin exceeds 10.

It is preferable that the amount of binder resin contained in the toner be 70% to 95% of the mass of the toner, more preferably, 80% to 90% of the mass of the toner. When the mass percentage of the binder resin contained in the toner is below the range described above, it becomes difficult to maintain the fixing characteristics, the durability, and the heat-resistant preservability of the toner. Meanwhile, when the mass percentage of the binder resin contained in the toner is greater than the range described above, the charging capability, the coloring properties, and the separating characteristics of the toner might become inadequate.

In addition, it is preferable that the binder resin include only the polyester resin described above. However, other thermoplastic resin (for example, styrene resin and styrene-acrylic resin) and thermosetting resin such as epoxy resin can be included at a mass percentage below 10% of the total mass of the binder resin as long as the glass transition temperature Tg of the toner shown in the DSC curve is in the range of 50° C. to 53° C., and the toner's various properties such as the charging characteristics (especially the electrostatic stability), the fixing characteristics, and the offset-resistance characteristics are not undermined. It is preferable that a charge control agent be added to the toner. By adding a charge control agent to the toner, it is possible to achieve a drastic improvement in the charging level and the charge rise characteristics (indicating whether a certain level of charging can be attained within a short period of time) of the toner. Thus, it is possible to obtain a toner having excellent characteristics such as durability and stability.

There is no specific restriction on the type of charge control agent. For example, it is preferable to use a charge control agent exhibiting positive charging characteristics such as nigrosine, quaternary ammonium compound, and a resin-type charge control agent formed by linking resin with an amine compound. It is also possible to simultaneously use a plurality of such charge control agents.

In particular, examples of the charge control agents include one type of or two or more types of the following: an azine compound such as pyridazine, pyrimidine, pyrazine, ortho oxazine, meth oxazine, para-oxazine, ortho-thiazine, meth thiazine, para-thiazine, 1,2,3-triazine, 1,2,4-triazine, 1,3,5-triazine, 1,2,4-oxadiazine, 1,3,4-oxadiazine, 1,2,6-oxadiazine, 1,3,4-thiadiazine, 1,3,5-thiadiazine, 1,2,3,4-tetrazine, 1,2,4,5-tetrazine, 1,2,3,5-tetrazine, 1,2,4,6-oxatriazine, 1,3,4,5-oxatriazine, phthalazine, quinazoline, quinoxaline; an azine compound-based direct dye such as azine first red FC , azine first red 12BK, azine violet BO, azine brown 3G, azine light brown GR, azine dark green BH/C, azine deep black EW, and azine deep black 3RL; a nigrosine compound such as nigrosine, nigrosine salt, and nigrosine derivative; a nigrosine compound-based acid dye such as nigrosine BK, nigrosine NB, nigrosine Z, metal salt of naphthene acid or higher fatty acid, alkoxyl amine, alkylamide; a quaternary ammonium such as benzyl methyl hexyldecylammonium and decyltrimethylammonium chloride. Nigrosine compounds are especially suitable for toners with positive charging properties because a faster charge rise can be obtained.

Additional examples include resin or oligomer comprising quaternary ammonium salt, resin or oligomer comprising carboxylic salt, and resin or oligomer comprising a carboxyl group. More specifically, examples include one type of or two or more types of the following: polystyrene resin comprising quaternary ammonium salt, acrylic resin comprising quaternary ammonium salt, styrene-acrylic resin comprising quaternary ammonium salt, polyester resin comprising quaternary ammonium salt, polyester resin comprising carboxylic salt, acrylic resin comprising carboxylic salt, styrene-acrylic resin comprising carboxylic salt, polyester resin comprising carboxylic salt, polystyrene resin comprising a carboxyl group, acrylic resin comprising a carboxyl group, a styrene-acrylic resin comprising a carboxyl group, and a polyester resin comprising a carboxyl group.

In particular, using styrene-acrylic resin (styrene-acrylic copolymer) having quaternary ammonium salt, carboxylic salt, or a carboxyl group as a functional group is most preferable, because the value of the charge amount can be easily controlled to fall within a predetermined range. Examples of preferred acrylic resin (the styrene-acrylic resin or the acrylic resin described above) include (meth)acrylic acid alkyl ester such as methyl acrylate, ethyl acrylate, n-propyl acrylate, iso-propyl acrylate, n-butyl acrylate, iso-butyl acrylate, 2-ethylhexyl acrylate, methyl methacrylate, ethyl methacrylate, n-butyl methacrylate, and iso-butyl methacrylate.

Furthermore, a monomer derived from dialkylaminoalkyl (meth)acrylate through a quaternarization process is used as a quaternary ammonium salt. Examples of preferred dialkylaminoalkyl(meth)acrylate used for the above derivation include di-(lower alkyl)-amino-ethyl(meth)acrylate such as dimethylamino-ethyl(meth)acrylate, diethylamino-ethyl (meth)acrylate, dipropylamino-ethyl(meth)acrylate, and dibutylamino-ethyl(meth)acrylate; dimethylmeth acrylamide; and dimethylaminopropyl methacrylamide. During the polymerization, it is also possible to use in combination, a polymerizable monomer having a hydroxy group, such as hydroxyethyl(meth) acrylate, hydroxypropyl(meth)acrylate, 2-hydroxybutyl(meth)acrylate, and n-methylol(meth)acrylamide.

It is preferable that the mass of the charge control agent included in the toner be in the range of 0.5% to 2% of the mass of the toner, more preferably, 1% to 1.5% of the mass of the toner. When the mass percentage of the charge control agent is below this range, it becomes difficult to provide stable charging characteristics to the toner. As a result, a decline in image density and a decline in durability tend to be observed. Moreover, poor dispersion can occur, which causes fogging and contamination of the photoreceptor. On the other hand, when the mass percentage of the charge control agent exceeds the range described above, the environmental resistance of the toner declines. Especially under high temperature and high humidity, the charging characteristics of the toner tend to decline, the image quality tends to worsen, and contamination of the photoreceptor tends to occur. Therefore, it is preferable that the mass percentage of the charge control agent fall within the range described above in order to attain a good balance between the charge controlling function of the toner and the durability of the toner.

A toner normally includes a coloring agent. A previously known coloring agent can be used. A dye or a pigment, and the like, may be used without any particular limitation. Examples of the coloring agent include carbon black, quinacridone, naphthol, carmine 6B, monoazo yellow, diazo yellow, phthalocyanine blue, anthraquinone, disazo, monoazo red, anilide compound, benzidine, benzimidazolon, and halogenated phthalocyanine. The amount of the coloring agent contained in the toner depends on the type of the coloring agent. However, it is generally preferred that the mass of the coloring agent included in the toner be in the range of 0.1% to 50% of the mass of the toner, more preferably, 0.5% to 20% of the mass of the toner.

The toner can be used as a magnetic toner by dispersing known magnetic powder in the toner. Examples of the magnetic powder include a metal or an alloy such as ferrite and magnetite exhibiting ferromagnetic properties and containing elements such as iron, cobalt, and nickel; an alloy or compound containing the above element; an alloy which does not include a ferromagnetic element but exhibits ferromagnetic properties when treated appropriately with heat; and chromium dioxide. The magnetic powder is in a fine powder form with an average particle size in the range of 0.1 μm to 1 μm, preferably 0.1 μm to 0.5 μm. In addition, the magnetic powder is dispersed evenly in the binder resin. The magnetic powder can be made up of a single substance. The magnetic powder can also be a substance that is surface-treated with a surface treatment agent such as a titanium coupling agent or a silane coupling agent.

The toner according to the present embodiment is obtained by first melt-kneading two or more types of releasing agents, a binder resin, and other various components described above, then crushing and classifying the substance obtained by the melt-kneading process. In particular, it is preferable that the two or more types of releasing agents are melt-blended in advance at a high temperature, and the blended material obtained from this process is melt-kneaded with the binder resin and other various components. This procedure allows the releasing agent and other various components to be well dispersed when the binder resin and the blended material are melt-kneaded while making the toner. As a result, the toner is equipped with more stable fixing properties and heat-resistant preservabilily characteristics. At the same time, the toner can be expected to have good charging stability. When a toner has good charging stability, the image density is maintained even when images are formed consecutively. Thus, a decline in image density is prevented.

It is preferable that the particle size of the toner thus obtained is generally in the range of 5 μm to 10 μm, more preferably, 6 μm to 8 μm.

In order to improve fluidity, the surface of the toner can be coated with a fluidity improving agent comprised of inorganic oxide such as hydrophobic silica and $TiO_2$. It is preferable that the mass of the fluidity improving agent coated on the toner be in the range of 0.1% to 10% when the mass of the components excluding the fluidity improving agent (in other words, the toner mother particle) is regarded as 100%. When toners are coated with the fluidity improving agent, it is preferable that the particle size of the toner mother particle is in the range of 5 μm to 10 μm, more preferably, 6 μm to 8 μm.

The toner can be used as a two-component developer by blending with magnetic carriers such as a ferrite carrier. The toner can also be used as a one-component developer on its own. It is also possible to use the toner as a full-color toner.

When the toner is used as a two-component toner, magnetic carriers such as ferrite and iron powder may be blended. In such cases, it is preferable that the mass of the toner is in the range of 5% to 20%, more preferably, 10% to 15% when the mass of the carrier is regarded as 100%.

As described above, a toner with excellent fixing properties such as low-temperature fixing characteristics and high-temperature offset resistance capability as well as excellent heat-resistant preservability properties can be obtained when at least two types of releasing agents are blended with the binder resin, the glass transition temperature Tg of the toner is in the range of 50° C. to 53° C., the differential scanning calorimeter measurement provides a DSC curve showing that an endotherm due to the releasing agent starts at a temperature in the range of 65° C. to 70° C., the endotherm due to the releasing agent ends at a temperature in the range of 135° C. to 140° C., the DSC curve has a lowest-temperature endothermic peak due to the releasing agent at a temperature in the range of 80° C. to 85° C., a highest-temperature endothermic peak at a temperature in the range of 127° C. to 133° C., and a local maximum point at a temperature in the range of 90° C. to 95° C. In particular, since multiple releasing agents operate in a well-balanced manner, the toner described above has excellent low-temperature fixing characteristics even when a binder resin with a lower glass transition temperature Tg is not used. As a result, it is possible to prevent a decline in heat-resistant preservability characteristics that occurs due to the use of a binder resin with a lower glass transition temperature Tg.

The above description concerned an example of a toner including two types of releasing agents with different melting points. However, as long as the DSC curve exhibits the above properties, the toner may include three or more types of releasing agents. In such a case, the DSC curve may exhibit a lowest-temperature endothermic peak (point C) and a highest-temperature endothermic peak (point D) each observed in the above temperature range. In addition, the DSC curve may further exhibit one or more other endothermic peaks, caused by the releasing agent, between point C and point D.

The DSC curve may exhibit a peak caused by a component other than the releasing agent.

Hereinafter, First to Sixth Embodiments of a toner for developing an electrostatic latent image according to the present invention are described with reference to the drawings. However, the present invention is not to be limited by these embodiments.

(First Embodiment)

First, wax A and wax B, which are releasing agents described below, are melt-blended at a mass ratio of 50:50 at a temperature of (the melting point of wax A±5)° C. A melt-blended material is thus obtained.

Next, the melt-blended material is blended with a polyester resin (a binder resin), a charge control agent, and a coloring agent using a Henschel mixer (manufactured by Mitsui Mining Co., Ltd.). Then, this compound is melt-kneaded using a two-axis extruder (PCM-30, manufactured by Ikegai Co., Ltd.). The compound is then coarsely crushed using a Rohto plex (manufactured by Toakikai factory).

Subsequently, the compound obtained above is crushed using a mechanical crusher (manufactured by Matsuzaka Giken Co., Ltd.) and sorted using an elbow-jet classifying machine (manufactured by Nittetsu Mining Co., Ltd.). A toner particle (toner mother particle) with a volume average particle diameter of 7 μm is thus obtained.

Considering the mass of the toner mother particle as 100%, the toner is produced by coating and blending oxidized titanium manufactured by Titan Kogyo Co., Ltd. (EC-100) at a mass of 2% and hydrophobic silica manufactured by Nippon Aerosil Co., Ltd. (RA-200H) at a mass of 1% using the Henschel mixer (manufactured by Mitsui Mining Co., Ltd.).

Next, considering the mass of the carrier as 100%, the toner thus obtained is blended with the ferrite carrier so that the mass of the toner is 14%. A two-component developer is thus obtained.

The toner obtained above was measured by means of a differential scanning calorimeter according to the method described below. In addition, the fixing properties of the toner (the low-temperature fixing characteristics, the high-temperature offset characteristics, and the separating characteristics), the heat-resistant preservability properties of the toner, and the printing durability properties (the stability of image density) of the toner were evaluated.

| | |
|---|---|
| polyester resin | 87 mass %; |
| wax A (800PF wax manufactured by Mitsui Chemicals, Inc.) | 3.5 mass %; |
| wax B (carnauba wax manufactured by Nippon Seiro Co., Ltd.) | 3.5 mass %; |
| charge control agent (Bontron N-21 manufactured by Orient Chemical Industries, Ltd.) | 1 mass %; |
| coloring agent (carbon black REGAL 330R manufactured by Cabot) | 5 mass % |

The polyester resin used above was manufactured as follows:

A propylene oxide adduct of bisphenol-A in the amount of 1,960 g, an ethylene oxide adduct of bisphenol A in the amount of 780 g, a dodecenyl anhydro-succinic acid in the amount of 257 g, the raw material monomer of terephthalic acid in the amount of 770 g, and a dibutyltin oxide in the amount of 4 g were reacted in nitrogen atmosphere at a temperature of 235° C. for eight hours. The reaction was further carried out under a pressure of 8.3 kPa for one hour. Trimellitic anhydride was then added to the reacting system at a temperature of 180° C. so that the acid value equals a predetermined value of 1 mg KOH/g to 30 mg KOH/g. The temperature was then raised at a rate of 10° C. per hour to a temperature of 210° C., and a reaction was carried out. The polyester resin was thus obtained.

Wax A is a polypropylene wax with a melting point of 127° C. Wax B is a plant-wax with a melting point in the range of 80° C. to 86° C.

[DSC Measurement of the Toner]

The toner was measured by means of a differential scanning calorimeter (a "DSC measurement") as follows. The glass transition temperature Tg of the toner, the endotherm starting temperature TB, the lowest endothermic peak temperature TC, the highest endothermic peak temperature TD, the endotherm ending temperature TE, and the in-between-peak temperature TF were also obtained as follows.

Figure 2:
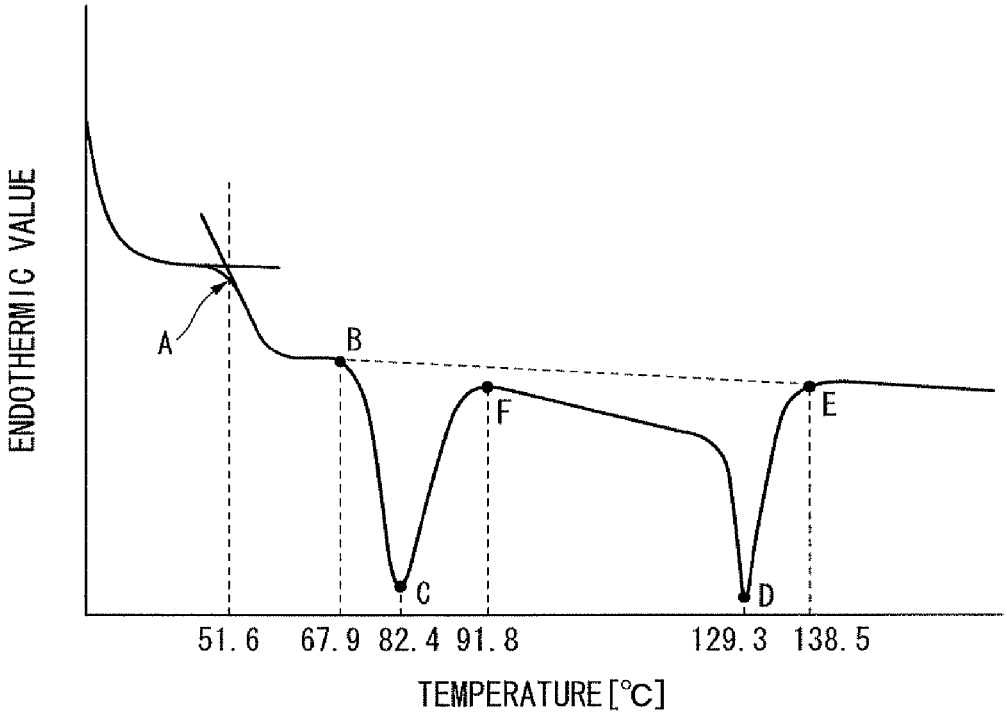
FIG. 2 shows a specific example of a DSC curve obtained by measuring the toner according to the above embodiment of the present invention.

The temperature of the sample (the toner) was raised to 170° C. using the differential scanning calorimeter DSC6200 manufactured by Seiko Instruments, Inc. The sample was then temporarily cooled at a rate of 10° C. per minute from 170° C. to 30° C. The sample was then heated at a rate of 10° C. per minute from 30° C. to 170° C. The DSC curve was thus obtained. FIG. 2 shows the DSC curve concerning the present embodiment. The amount of the sample was 10 mg. The two tangential lines flanking the shoulder of the DSC curve intersect at the glass transition temperature Tg.

[Evaluation of the Fixing Properties of the Toner]

The following evaluation was performed using the color printer FS-C5016 manufactured by Kyocera Mita Corp. A fixed evaluation device corresponding to the color printer was also used.

(1) Low-Temperature Fixing Characteristics

The two-component developer produced by the method described above was filled into the color printer FS-C5016 manufactured by Kyocera Mita Corp. An unfixed image of the toner image (a patch sample of 2 cm×3 cm) was outputted to the evaluation paper (Color Copy 90 manufactured by Neusiedl Inc.) so that the amount of toner mounted on the paper is 1.8 mg/cm$^2$. The fixing temperature was then changed every 5° C. At the same time, the unfixed image of the patch sample was fixed at a linear velocity of 97 mm per second using the fixed evaluation device. Next, the sample was folded in half, and the sample was rubbed back and forth for five times with a weight of 1 kg. The low-temperature fixing characteristics were evaluated according to the degree with which the toner peeled off when the folded sample was opened.

Toners with a peeling width of less than 1 mm (no problem occurring in practical use) at a fixing temperature of 120° C. were considered passing, denoted as "GOOD" in the table. On the other hand, a peeling width of approximately 1 mm (no problem occurring in practical use, but hardly no margin left) and a peeling width greater than 1 mm (problem occurs in practical use) were considered failing, denoted as "POOR" in the table.

(2) High-Temperature Offset Resistance

The two-component developer produced by the method described above was filled into the developing equipment of the color printer FS-C5016 manufactured by Kyocera Mita Corp. An unfixed image of the toner image (a patch sample of 2 cm×3 cm) was outputted to the evaluation paper (high-quality PPC) so that the amount of toner mounted on the paper equals 1.8 mg/cm$^2$. The fixing temperature was then changed every 5° C. At the same time, the unfixed image of the patch sample was fixed at a linear velocity of 49 mm per second using the fixed evaluation device. From the toner image of the evaluation paper, it was then determined whether or not a high-temperature offset occurred.

Toners with no high-temperature offset occurring at a fixing temperature of 200° C. were considered passing, denoted as "GOOD" in the table. Toners with high-temperature offset occurring at a fixing temperature of 200° C. were considered failing, denoted as "POOR" in the table.

(3) Separating Characteristics

The two-component developer produced by the method described above was filled into the developing device of the color printer FS-C5016 manufactured by Kyocera Mita Corp. An unfixed image of the toner image (an entirely black image with a margin of 5 mm on the edge of the paper) was outputted to the evaluation paper (high-quality PPC) so that the toner mounted on the paper equals a predetermined amount. At a fixing temperature of 180° C., the unfixed image of the patch sample was fixed at a linear velocity of 72 mm per second using the fixed evaluation device. During this procedure, the amount of toner mounted on the paper was increased at a rate of 0.1 mg/cm$^2$. In cases where the evaluation paper started adhering to the fixing roller (heating roller) of the fixed evaluation device when the amount of toner mounted on the paper was 2.4 mg/cm$^2$ or greater, the toner was considered passing, denoted as "GOOD" in the table. On the other hand, in cases where the evaluation paper started adhering to the fixing roller (heating roller) of the fixed evaluation device when the amount of toner mounted on the paper was less than 2.4 mg/cm$^2$, the toner was considered failing, denoted as "POOR" in the table.

[Evaluation of the Heat-Resistant Preservability Properties of the Toner]

Ten grams of toner were poured into a sample bottle. The toner in the sample bottle was then left in a thermostatic chamber (CONVECTION OVEN SANYO) at a temperature of 50° C. for 100 hours.

The day after the sample bottle containing the toner was taken out of the thermostatic chamber, the following inversion evaluation, cohesion evaluation, and sifting evaluation (measuring the amount of substance remaining in a sieve after sifting) were performed. The results of these three evaluations were analyzed as a whole. The degree of heat-resistant preservability property was rated in three steps from 3 to 1 as follows. The result is shown in the table.

storage capability 3: No problem occurring in practical use;

storage capability 2: No problem occurring in practical use, but no margin left;

storage capability 1: Problem occurs in practical use

Inversion Evaluation:

The sample bottle containing the toner was tilted. The manner in which the toner collapsed was evaluated. In cases where the toner collapsed when the sample bottle was tilted at an angle of 90°, the toner was considered "good." In cases where the toner would not fall out even though the sample bottle was tilted at an angle of 180° and the bottle was tapped on, the toner was considered "not good." The degree to which the toner was "good" or "not good" was evaluated on a five-step scale.

Cohesion Evaluation:

After the above inversion evaluation was performed, the sample bottle was slowly shaken ten times. The toner contained in the sample bottle was then taken out on a paper. It was observed how the toner clumped together. Toners that did not clump together were considered "the best." Toners that clumped together and did not collapse at all were considered "the worst." The degree to which cohesion of the toner occurred was evaluated on a five-step scale.

Sifting Evaluation (Measuring the Amount of Substance Remaining in a Sieve After Sifting):

A sieve with 26 meshes with a known mass was clamped onto a powder tester (TYPE PT-E 84810 manufactured by the Hosokawa Micron Group). The toner contained in the sample bottle was placed on the mesh. The toner was then sifted for 20 seconds under the condition of rheostat 2.5. The mass of the toner remaining on the sieve was measured. When the mass of the toner remaining on the sieve was less than or equal to 0.2 g, the toner was considered passing.

[Evaluation of the Printing Durability Properties (Stability of Image Density)]

Using a page printer (FS-C5030N) manufactured by Kyocera Mita Corp., 30,000 sheets were continuously printed under normal conditions (20° C., 65%). Then, the image evaluation pattern (bias adjustments are made so that the amount of toner mounted on the paper is 0.5 mg/cm$^2$) was printed as an image. The image density of the image thus obtained was measured using a Macbeth reflection densitometer (RD914 manufactured by GretagMacbeth Inc.). Evaluation was made on a three-step scale. The evaluation results are shown in the table.

GOOD: the image density is greater than or equal to 1.30;

ACCEPTABLE: the image density is greater than or equal to 1.00 and is less than 1.30;

POOR: the image density is less than 1.00

(Second Embodiment)

Wax A and wax B were blended at a mass ratio of (wax A):(wax B)=40:60. Other than this ratio, the toner and the two-component developer were produced in the same way as in the First Embodiment described above. In addition, the DSC measurements were made as in the First Embodiment. The respective evaluations were also carried out. The results are shown in the table as well.

(Third Embodiment)

Wax A and wax B were blended at a mass ratio of (wax A):(wax B)=60:40. Other than this ratio, the toner and the two-component developer were produced in the same way as in the First Embodiment described above. In addition, the DSC measurements were made as in the First Embodiment. The respective evaluations were also carried out. The results are shown in the table as well.

COMPARATIVE EXAMPLE 1

Wax A and wax B were blended at a mass ratio of (wax A):(wax B)=70:30. Other than this ratio, the toner and the two-component developer were produced in the same way as in the First Embodiment described above. In addition, the DSC measurements were made as in the First Embodiment. The respective evaluations were also carried out. The results are shown in the table as well.

COMPARATIVE EXAMPLE 2

Wax A and wax B were blended at a mass ratio of (wax A):(wax B)=30:70. Other than this ratio, the toner and the two-component developer were produced in the same way as in the First Embodiment described above. In addition, the DSC measurements were made as in the First Embodiment. The respective evaluations were also carried out. The results are shown in the table as well.

COMPARATIVE EXAMPLE 3

Instead of wax B, an ester wax (Nissan Electol WEP-5 manufactured by NOF Corporation) with a melting point of 92° C. was used. Other than the use of this ester wax, the toner and the two-component developer were produced in the same way as in the First Embodiment described above. In addition, the DSC measurements were made as in the First Embodiment. The respective evaluations were also carried out. The results are shown in the table as well.

COMPARATIVE EXAMPLE 4

Instead of wax B, an ester wax (Nissan Electol WEP-4 manufactured by NOF Corporation) with a melting point of 67° C. was used. Other than the use of this ester wax, the toner and the two-component developer were produced in the same way as in the First Embodiment described above. In addition, the DSC measurements were made as in the First Embodiment. The respective evaluations were also carried out. The results are shown in the table as well.

COMPARATIVE EXAMPLE 5

Instead of wax A, a polypropylene wax (Hi-wax NP055 manufactured by Mitsui Chemicals, Inc.) with a melting point of 139° C. was used. Other than the use of this polypropylene wax, the toner and the two-component developer were produced in the same way as in the First Embodiment described above. In addition, the DSC measurements were made as in the First Embodiment. The respective evaluations were also carried out. The results are shown in the table as well.

COMPARATIVE EXAMPLE 6

Instead of wax A, a polyethylene wax (Hi-wax 410P manufactured by Mitsui Chemicals, Inc.) with a melting point of 118° C. was used. Other than the use of this polyethylene wax, the toner and the two-component developer were produced in the same way as in the First Embodiment described above. In addition, the DSC measurements were made as in the First Embodiment. The respective evaluations were also carried out. The results are shown in the table as well.

COMPARATIVE EXAMPLE 7

The polyester resin used as the binder resin was adjusted so that the glass transition temperature Tg of the toner equals the value shown in the table (48.1° C.). Other than this adjustment, the toner and the two-component developer were produced in the same way as in the First Embodiment described above. In addition, the DSC measurements were made as in the First Embodiment. The respective evaluations were also carried out. The results are shown in the table as well.

COMPARATIVE EXAMPLE 8

The polyester resin used as the binder resin was adjusted so that the glass transition temperature Tg of the toner equals the value shown in the table (54.5° C.). Other than this adjustment, the toner and the two-component developer were produced in the same way as in the First Embodiment described above. In addition, the DSC measurements were made as in the First Embodiment. The respective evaluations were also carried out. The results are shown in the table as well.

(Fourth, Fifth, and Sixth Embodiments)

COMPARATIVE EXAMPLES 9-16

During the process of producing the toner, waxes A and B, which serve as releasing agents, are not melt-blended in advance. Instead, the polyester resin (binder resin), the charge control agent, and the coloring agent are mixed all at once using a Henschel mixer (manufactured by Mitsui Mining Co., Ltd.), and are melt-kneaded using a twin-screw extruder. Aside from the point described above, the toner and the two-component developer were produced and the DSC measurements were made in the Fourth Embodiment in the same way as in the First Embodiment, the Fifth Embodiment in the same way as in the Second Embodiment, the Sixth Embodiment in the same way as in the Third Embodiment, Comparative Example 9 in the same way as in Comparative Example 1, Comparative Example 10 in the same way as in Comparative Example 2, Comparative Example 11 in the same way as in Comparative Example 3, Comparative Example 12 in the same way as in Comparative Example 4, Comparative Example 13 in the same way as in Comparative Example 5, Comparative Example 14 in the same way as in Comparative Example 6, Comparative Example 15 in the same way as in Comparative Example 7, and Comparative Example 16 in the same way as in Comparative Example 8. The respective evaluations were also carried out. The results are shown in the table as well. The printing durability properties of the toner were evaluated only in the Fourth Embodiment.

TABLE 1

| | Tg (Point A) [° C.] | TB (Point B) [° C.] | TC (Point C) [° C.] | TD (Point D) [° C.] | TE (Point E) [° C.] | TF (Point F) [° C.] |
|---|---|---|---|---|---|---|
| FIRST EMBODIMENT | 51.6 | 67.9 | 82.4 | 129.3 | 138.5 | 91.8 |
| SECOND EMBODIMENT | 52.7 | 65.5 | 80.6 | 127.5 | 136.4 | 90.6 |
| THIRD EMBODIMENT | 50.3 | 69.6 | 84.7 | 132.6 | 139.1 | 94.6 |
| COMPARATIVE EXAMPLE 1 | 50.6 | 64.7 | 80.1 | 132.2 | 139.6 | 87.6 |
| COMPARATIVE EXAMPLE 2 | 51.4 | 68.8 | 82.5 | 129.4 | 135.8 | 96.2 |
| COMPARATIVE EXAMPLE 3 | 52.2 | 75.7 | 93.4 | 130 | 136.1 | 105.4 |
| COMPARATIVE EXAMPLE 4 | 51.6 | 58.7 | 67.7 | 129.4 | 137 | 78.8 |
| COMPARATIVE EXAMPLE 5 | 52.4 | 66 | 82.1 | 140.6 | 146.5 | 101.2 |
| COMPARATIVE EXAMPLE 6 | 50.8 | 68.5 | 84 | 118.2 | 125.3 | 88.4 |
| COMPARATIVE | 48.1 | 66.6 | 82.9 | 129.3 | 136.2 | 92.6 |

TABLE 1-continued

| | Tg (Point A) [° C.] | TB (Point B) [° C.] | TC (Point C) [° C.] | TD (Point D) [° C.] | TE (Point E) [° C.] | TF (Point F) [° C.] |
|---|---|---|---|---|---|---|
| EXAMPLE 7 | | | | | | |
| COMPARATIVE EXAMPLE 8 | 54.5 | 65.3 | 83.6 | 130.8 | 137.8 | 93.6 |

TABLE 2

| | LOW-TEMPERATURE FIXING | HIGH-TEMPERATURE OFFSET RESISTANCE | RELEASABILITY | HEAT-RESISTANT STORAGE | PRINTING DURABILITY |
|---|---|---|---|---|---|
| FIRST EMBODIMENT | GOOD | GOOD | GOOD | 3 | GOOD |
| SECOND EMBODIMENT | GOOD | GOOD | GOOD | 3 | GOOD |
| THIRD EMBODIMENT | GOOD | GOOD | GOOD | 3 | GOOD |
| COMPARATIVE EXAMPLE 1 | POOR | GOOD | GOOD | 2 | GOOD |
| COMPARATIVE EXAMPLE 2 | GOOD | POOR | GOOD | 2 | GOOD |
| COMPARATIVE EXAMPLE 3 | POOR | GOOD | GOOD | 2 | GOOD |
| COMPARATIVE EXAMPLE 4 | GOOD | POOR | POOR | 2 | GOOD |
| COMPARATIVE EXAMPLE 5 | POOR | GOOD | GOOD | 2 | GOOD |
| COMPARATIVE EXAMPLE 6 | GOOD | POOR | GOOD | 2 | GOOD |
| COMPARATIVE EXAMPLE 7 | GOOD | POOR | POOR | 1 | GOOD |
| COMPARATIVE EXAMPLE 8 | POOR | GOOD | GOOD | 3 | — |

35

TABLE 3

| | Tg (Point A) [° C.] | TB (Point B) [° C.] | TC (Point C) [° C.] | TD (Point D) [° C.] | TE (Point E) [° C.] | TF (Point F) [° C.] |
|---|---|---|---|---|---|---|
| FOURTH EMBODIMENT | 51.5 | 68.2 | 82.3 | 129.1 | 138.3 | 92 |
| FIFTH EMBODIMENT | 52.8 | 65.3 | 80.9 | 128.2 | 136.1 | 91.2 |
| SIXTH EMBODIMENT | 50.6 | 69.5 | 84.5 | 132.5 | 139.2 | 94.5 |
| COMPARATIVE EXAMPLE 9 | 50.3 | 64.9 | 80.3 | 132.5 | 139.8 | 87.5 |
| COMPARATIVE EXAMPLE 10 | 51 | 68.7 | 83.2 | 129.5 | 135.4 | 96.8 |
| COMPARATIVE EXAMPLE 11 | 52.1 | 75.6 | 93.1 | 130.2 | 136.2 | 105.1 |
| COMPARATIVE EXAMPLE 12 | 51.8 | 58.9 | 67.8 | 128.9 | 137.1 | 78.6 |
| COMPARATIVE EXAMPLE 13 | 52.3 | 66.2 | 82.5 | 140 | 146.1 | 99.8 |
| COMPARATIVE EXAMPLE 14 | 50.5 | 68.4 | 83.4 | 118.4 | 124.9 | 88.8 |
| COMPARATIVE EXAMPLE 15 | 48.1 | 66.8 | 83.2 | 128.9 | 135.9 | 92.5 |
| COMPARATIVE EXAMPLE 16 | 54.6 | 65.9 | 83.8 | 131.2 | 137.8 | 93.9 |

TABLE 4

| | LOW-TEMPERATURE FIXING | HIGH-TEMPERATURE OFFSET RESISTANCE | RELEASABILITY | HEAT-RESISTANT STORAGE | PRINTING DURABILITY |
|---|---|---|---|---|---|
| FOURTH EMBODIMENT | GOOD | GOOD | GOOD | 3 | ACCEPTABLE |
| FIFTH EMBODIMENT | GOOD | GOOD | GOOD | 3 | — |
| SIXTH EMBODIMENT | GOOD | GOOD | GOOD | 3 | — |
| COMPARATIVE EXAMPLE 9 | POOR | GOOD | GOOD | 2 | — |
| COMPARATIVE EXAMPLE 10 | GOOD | POOR | GOOD | 2 | — |
| COMPARATIVE EXAMPLE 11 | POOR | GOOD | GOOD | 2 | — |
| COMPARATIVE EXAMPLE 12 | GOOD | POOR | POOR | 2 | — |
| COMPARATIVE EXAMPLE 13 | POOR | GOOD | GOOD | 2 | — |
| COMPARATIVE EXAMPLE 14 | GOOD | POOR | GOOD | 2 | — |
| COMPARATIVE EXAMPLE 15 | GOOD | POOR | POOR | 1 | GOOD |
| COMPARATIVE EXAMPLE 16 | POOR | GOOD | GOOD | 3 | — |

Concerning the First, Second and Third Embodiments as well as the Fourth, Fifth, and Sixth Embodiments, the glass transition temperature Tg of the toner and the temperatures TB-TF corresponding to points B-F shown in the DSC curve all fall within a certain range. As a result, the toner has excellent fixing properties (low-temperature fixing characteristics, high-temperature offset resistance characteristics, and separating properties) as well as good heat-resistant preservability properties in these Embodiments. Concerning the First-Third Embodiments, the wax was melt-blended in advance. Thus, the toners in the First-Third Embodiments have good printing durability properties. The image density of the toners in the First-Third Embodiments was stable even after 30,000 pages were printed.

In each of these Embodiments, the glass transition temperature Tg of the toner is in the range of 90° C. to 95° C. The releasing agent with the lower melting point (the first releasing agent) melted in a low temperature and therefore enhanced the low-temperature fixing characteristics of the toner. On the other hand, the releasing agent with the higher melting point (the second releasing agent) absorbed heat at a high temperature and therefore prevented heat from spreading to the binder resin in the toner. As a result, it is possible to prevent the heat-resistant properties from declining due to the binder resin. Consequently, the toner obtains good heat-resistant preservability properties. In addition, the temperatures Tg, TB, TC, TD, and TE are all within a certain range. Therefore, the toner not only has excellent low-temperature fixing properties and heat-resistant preservability properties, but also has excellent high-temperature offset resistance properties and separating properties.

Meanwhile, in Comparative Examples 1, 2, 9, and 10, the two types of waxes were not blended in an appropriate ratio. As a result, the temperature TF was outside of a certain range. Further, since the two types of waxes did not operate in a well-balanced manner, the toner did not have adequate fixing properties and heat-resistant preservability properties.

Concerning Comparative Examples 3-6, and 11-14, at least one temperature among TF, TB, TC, TD, and TE fell outside of a certain range. As a result, the fixing properties and heat-resistant preservability properties of the toner were inadequate.

In Comparative Examples 7, 8, 15, and 16, the glass transition temperature Tg was outside of a certain range. Therefore, since temperatures TB-TF were within a certain range, the fixing properties of the toner worsened. Toners associated with a low glass transition temperature Tg exhibited decreased heat-resistant preservability properties.

While a preferable embodiment of the present invention has been described above, it should be understood that these are exemplary of the invention and are not to be considered as limiting the present invention. For instance, combinations of each constituent material described in the above embodiments are only exemplary. Additions, omissions, substitutions, and other modifications concerning the constituent material can be made without departing from the spirit or scope of the present invention.

The invention is not to be considered as being limited by the foregoing description, and is only limited by the scope of the appended claims.

What is claimed is:

1. A toner for developing an electrostatic latent image, the toner comprising:

a releasing agent; and a binder resin, wherein:

the releasing agent includes at least a first releasing agent material and a second releasing agent material, the first releasing agent material having a different melting point compared to the second releasing agent material; and a differential scanning calorimetric curve, obtained by measuring the toner for developing the electrostatic latent image by means of a differential scanning calorimeter, exhibits a shoulder at a temperature in a range of 50° C. to 53° C. corresponding to a glass transition temperature of the toner for developing the electrostatic latent image, and also exhibits a local maximum point at a temperature in a range of 90° C. to 95° C., and wherein the differential scanning calorimetric curve exhibits an endotherm starting temperature caused by the releasing agent in a range of 65° C. to 70° C., an endotherm ending temperature caused by the releasing agent in a range of 135° C. to 140° C., a lowest endothermic peak temperature caused by the first releasing agent material in a range of 80° C. to 85° C., and a highest endothermic peak temperature caused by the second releasing agent material in a range of 127° C. to 133° C.; and the local maximum point is in a region below a baseline that connects an endotherm starting point corresponding to an endotherm starting temperature and an endotherm ending point corresponding to an endotherm ending temperature.

2. The toner for developing the electrostatic latent image according to claim 1, wherein the binder resin is a polyester resin.

3. The toner for developing the electrostatic latent image according to claim 1, wherein the first releasing agent material and the second releasing agent material are melt-blended in advance, creating a melt-blended material, and the melt-blended material is melt-kneaded with the binder resin.

4. The toner for developing the electrostatic latent image according to claim 1, wherein a mass of the first releasing agent material contained in the toner for developing the electrostatic latent image is in a range of 40% to 60% of a total mass of the first releasing agent material and the second releasing agent material.

5. The toner for developing the electrostatic latent image according to claim 1, wherein a mass of the first releasing agent material contained in the toner for developing the electrostatic latent image is in a range of 45% to 55% of a total mass of the first releasing agent material and the second releasing agent material.

6. The toner for developing the electrostatic latent image according to claim 1, wherein the local maximum point is a temperature between the lowest endothermic peak temperature and the highest endothermic peak temperature.

7. The toner for developing the electrostatic latent image according to claim 1, wherein a total amount of the first releasing agent material and the second releasing agent material included in the toner is 4% to 10% of the mass of the toner.

8. The toner for developing the electrostatic latent image according to claim 1, wherein a total amount of the first releasing agent material and the second releasing agent material included in the toner is 5% to 7% of the mass of the toner.

9. The toner for developing the electrostatic latent image according to claim 1, wherein an amount of binder resin included in the toner is 70% to 95% of the mass of the toner.

10. The toner for developing the electrostatic latent image according to claim 1, wherein an amount of binder resin included in the toner is 80% to 90% of the mass of the toner.

11. The toner for developing the electrostatic latent image according to claim 1, wherein a mass of the charge control agent included in the toner is in the range of 0.5% to 2% of the mass of the toner.

12. The toner for developing the electrostatic latent image according to claim 1, wherein a mass of the charge control agent included in the toner is in the range of 1% to 1.5% of the mass of the toner.

* * * * *